US005105199A

United States Patent [19]

Ukmar

[11] Patent Number: 5,105,199

[45] Date of Patent: Apr. 14, 1992

[54] METHOD AND APPARATUS FOR TUBE ELEMENT BRACKET

[75] Inventor: Milosh Ukmar, Plano, Tex.

[73] Assignee: Alliance Telecommunictions Corporation, Dallas, Tex.

[21] Appl. No.: 395,051

[22] Filed: Aug. 17, 1989

[51] Int. Cl.[5] ..... H01Q 9/04

[52] U.S. Cl. ..... 343/791; 343/792; 29/517; 29/600; 174/28

[58] Field of Search ..... 343/791, 792, 790, 892, 343/900; 248/221.3, 221.4, 316.2; 29/517, 600; 174/28

[56] References Cited

U.S. PATENT DOCUMENTS

| | | | |
|---|---|---|---|
| 1,773,522 | 8/1930 | Delery | 29/517 |
| 2,265,794 | 12/1941 | Aske, Jr. | 343/888 |
| 2,359,084 | 9/1944 | Carlson | 29/517 |
| 2,605,412 | 7/1952 | Riblet | 343/792 |
| 2,666,613 | 1/1954 | Astleford | 248/221.3 |
| 3,381,261 | 4/1968 | Deakin | 439/851 |
| 3,871,000 | 3/1975 | Tymann | 343/791 |
| 4,352,109 | 9/1982 | Reynolds et al. | 343/792 |

FOREIGN PATENT DOCUMENTS

| | | | |
|---|---|---|---|
| 44-17649 | 8/1969 | Japan | 343/715 |

*Primary Examiner*—Michael C. Wimer
*Assistant Examiner*—Hoanganh Le
*Attorney, Agent, or Firm*—Richards, Medlock & Andrews

[57] ABSTRACT

An improved bracket is disclosed formed by a tube element (10). Opposing slots (26, 28) are formed into the tube element a predetermined distance from a first end (22) of the tube element. The opposing arcuate sections (30, 32) defined by those slots are deformed by cooperating dies (34, 36) to form the bracket. The tube element (10) can be a tubular antenna (206) secured along an antenna rod (202).

9 Claims, 2 Drawing Sheets

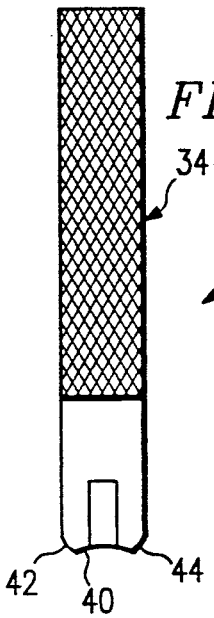
FIG. 6
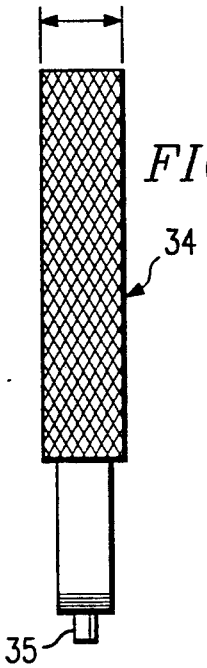
FIG. 7
FIG. 9
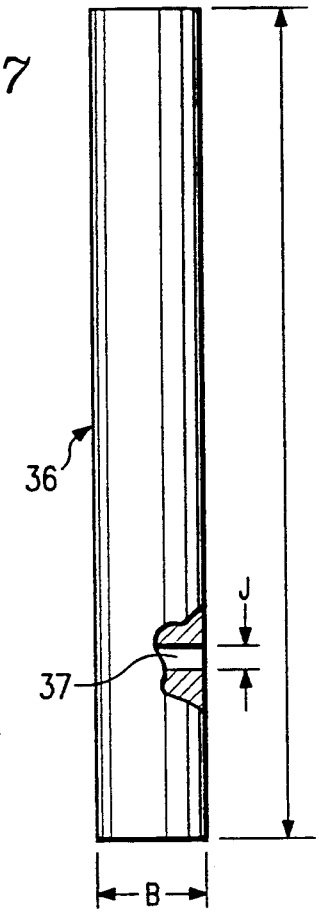
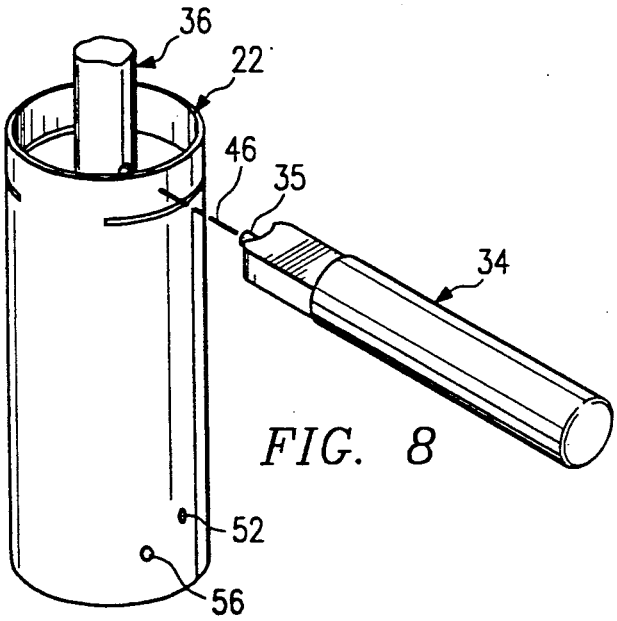
FIG. 8
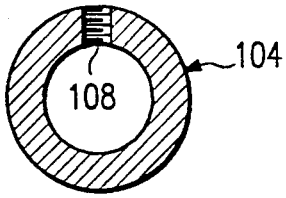
FIG. 10
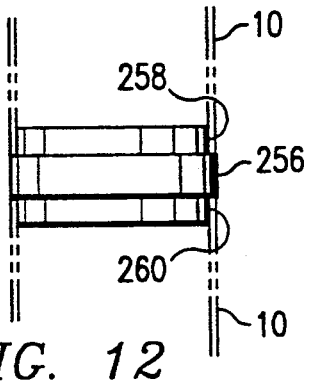
FIG. 12
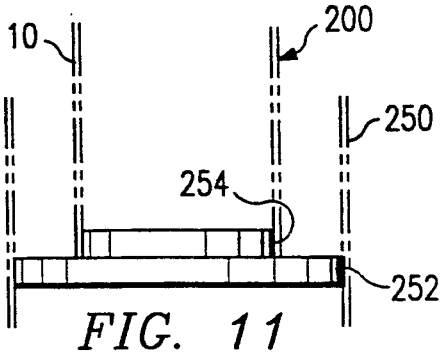
FIG. 11

METHOD AND APPARATUS FOR TUBE ELEMENT BRACKET

TECHNICAL FIELD

This invention relates to the manufacture of brackets, particularly for use in mounting antenna or radiating elements.

BACKGROUND OF THE INVENTION

In the evermore competitive manufacturing environment, methods to reduce manufacturing costs, while producing a quality product, are always desirable. One of the more basic manufactured products is a bracket to attach one member to another as, for example, a bracket to attach a tubular antenna along an antenna rod.

In constructing an antenna for propagation of signals in frequency ranges including, for example, 450 Megahertz and 800 Megahertz, it is common to provide a thin hollow antenna rod with larger diameter tubular antennae distributed along the length of the rod in a precise orientation to maximize signal propagation. Presently, such antennae are commonly constructed of a brass end which slides over the rod and is soldered thereto and a tubular antenna which is soldered to the end so as to be concentric with the rod. The end is a relatively expensive piece to manufacture, being machined from a section of rod. Also, the soldering to ensure proper electrical contact is tedious and difficult.

Other designs have swaged the end of a tubular antenna to a diameter corresponding to the diameter of the antenna rod. The swaged end is then soldered directly to the antenna rod. However, the swaging provides a variation in cross section, which creates undesirable impedances in the antenna.

A need exists for an improved tubular antenna mounting bracket, which overcome the shortcomings present in the state of the art.

SUMMARY OF THE INVENTION

In accordance with one aspect of the present invention, a method is provided for making a bracket in a tube of first diameter forming an antenna. The method includes the steps of cutting opposed slots into the tube at a predetermined distance from an end of the tube, with the slots generally perpendicular the center line of the tube. The method continues with the step of deforming the opposing arcuate sections of the tube formed between the slots and the end of the tube toward the center line of the tube to form a bracket.

In accordance with another aspect of the present invention, the step of deforming the opposing arcuate sections includes the steps of positioning a rod of predetermined external diameter into the tube coaxial with the center line of the tube. The rod extends for at least a substantial portion of the distance between the end of the tube and the slots. The method further includes the step of moving opposing dies together along a direction perpendicular the center line of the tube to deform the opposing arcuate sections against the rod.

In accordance with yet another aspect of the present invention, a tube element is provided which forms a bracket. The tube is of first diameter and has opposed slots cut into it at a predetermined distance from the end of the tube, with the slots generally perpendicular the center line of the tube. The opposing arcuate sections of the tube formed between the slots and the end of the tube are deformed toward the center line of the tube to form a bracket.

BRIEF DESCRIPTION OF THE DRAWINGS

Further objects and advantages of the invention will be become more apparent from the following description and claims, and from the accompanying drawings, wherein:

FIG. 6 is a plan view of a die forming part of the present invention;

FIG. 7 is a side view of the die;

FIG. 8 is a perspective view illustrating the process of manufacture of the tube element;

FIG. 9 is a side view of a rod used to support the non-deformed portions of the tube element;

FIG. 10 is a side view of a collar used with the rod.

FIG. 11 is a cross sectional view of an insulating centering disc; and

FIG. 12 is a vertical cross sectional view of an insulating spacer used with the tube antenna.

DETAILED DESCRIPTION

Figure 1:
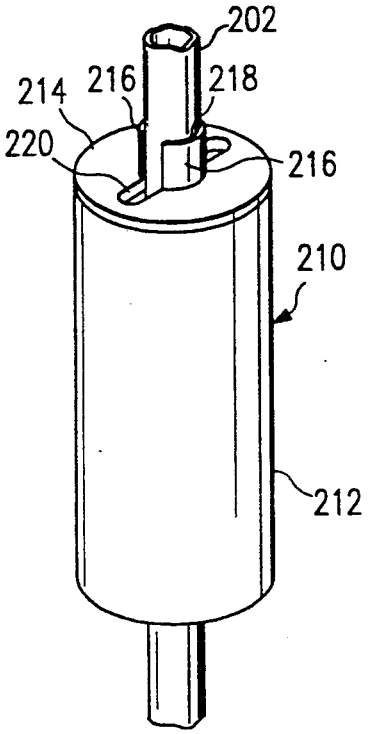
FIG. 1 (PRIOR ART)
FIG. 1 is a perspective view of a prior art antenna using a brass end.

With reference to the accompanying figures, wherein like reference numerals designate like or corresponding parts throughout the several views, the present invention is explained hereinafter.

Figure 3:
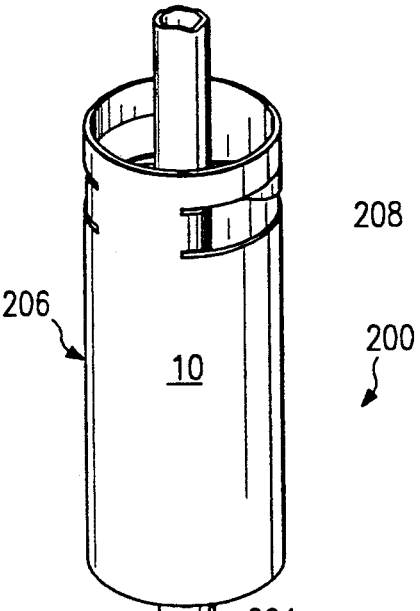
FIG. 3 is a perspective view of an antenna assembly incorporating a tube antenna forming a first embodiment of the present invention.

With reference to FIG. 3, an antenna assembly 200 is illustrated which includes an antenna rod 202 carrying a series of conductors 204 from a transmitting source. A series of tubular antennae 206 are secured along the antenna rod 202 for radiating electromagnetic radiation. An antenna assembly 200 of the type illustrated would be useful in transmitting electromagnetic signals in the frequency range including 450 and 800 mega cycles.

FIG. 1 illustrates a tube element 210 such as previously used to form the tubular antennae 206. The tube element includes a brass tube 212 and a brass end 214 which is soldered to one end of the tube 212. The end 214 is machined from a solid disc of brass by turning the disc down to form arcuate segments 216. Arcuate segments 216 are concentric about a circular aperture 218 drilled through the end and an overlapping slot 220. An annular step is also formed on the end to fit within the brass tube 212.

The antenna rod 202 is slid through the aperture 218 until the end 214 is positioned on the rod where desired. The end 214 can then be soldered or otherwise fastened to the rod. The brass tube 212 can be soldered to the end 214 either prior to mounting the end on the antenna rod, or subsequent thereto. The slots 220 provide a passage for the conductors 204 passing along the rod.

As can be readily appreciated, the manufacture of the tube element 210, and particularly end 214, is relatively costly and time consuming. Further, two separate soldering steps must be made, soldering the end to the rod and the tube to the end. Also, the end 214 is relatively thick and has a high heat capacity, which makes soldering the end difficult and gives rise to the possibility of a non-conductive cold solder joint.

Figure 2:
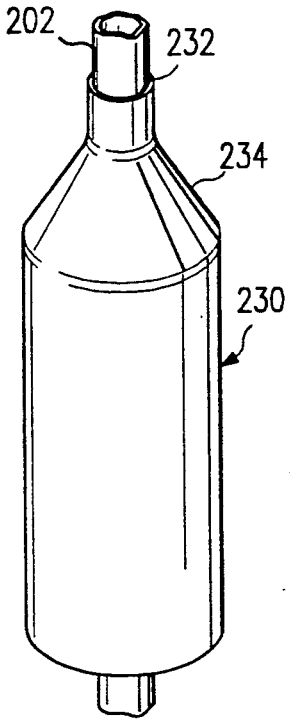
FIG. 2 (PRIOR ART)
FIG. 2 is a perspective view of a prior art antenna having a swaged end.

A tube element 230, illustrated in FIG. 2, is another type of element which can be used for the tubular antennae 206. The tube element 230 is manufactured from a brass tube which is swaged or spun down in size at one end to form an opening 232 having a diameter of about the diameter of antenna rod 202. The tube element 230 can then be soldered to the rod at opening 232. Tube element 230 has a bell shaped portion 234 which increases impedance of the antenna assembly to an undesirable degree.

Figure 4A:
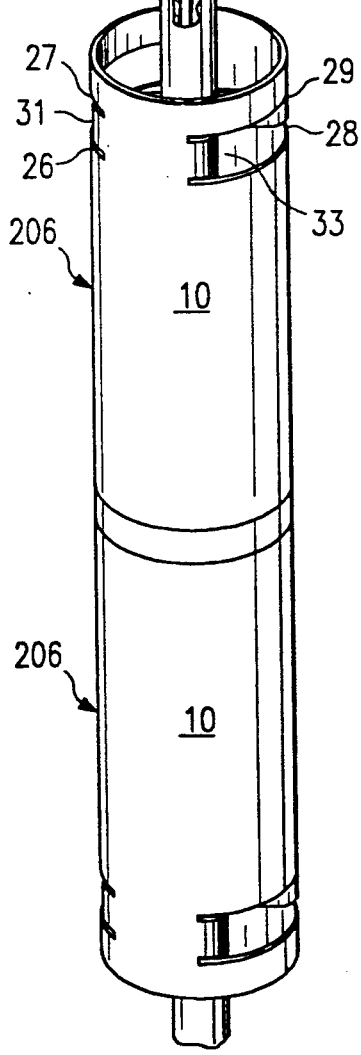
FIG. 4A is a side view of a tube element formed in accordance with the teachings of the present invention.
Figure 4A:
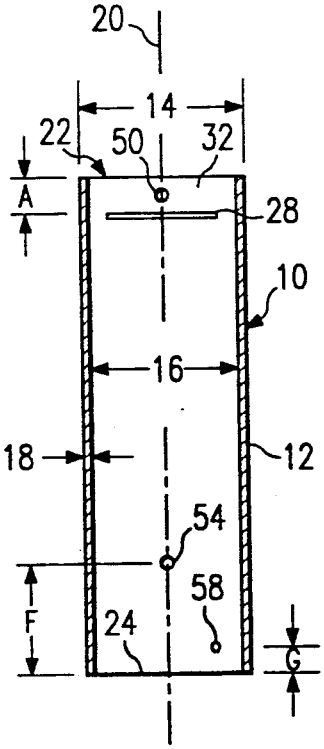
Figure 4B:
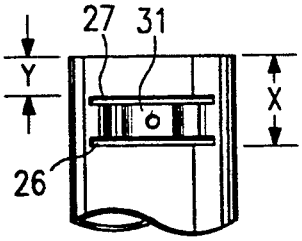
FIG. 4B is a side view of a modified tube element.
Figure 5:
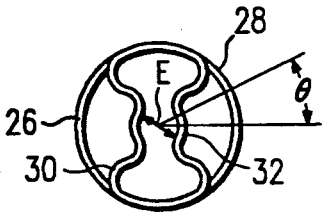
FIG. 5 is an end view of the tube element.

As seen in FIGS. 3, 4 and 5, tube element 10 is provided which can act as tubular antenna or radiating element 206 and as a bracket to attach the antenna to antenna rod 202 or the like. The tube element 10 can be seen to be formed from a section of tubing 12 having an outside diameter 14, an inside diameter 16 and a wall thickness 18. The tube element 10 is symmetric about its center line 20 and has a first end 22 and a second end 24.

The first step in making tube element 10 into a bracket is to cut opposing slits 26 and 28 through the side wall of the tube element a distance A from the first end. Preferably, each slot extends only a portion of the circumference of the tube element, leaving opposing arcuate sections 30 and 32. For example, each slit may be made for about a 90° arc, leaving half of the entire circumference of the tube element intact.

With reference now to FIGS. 6–10, cooperating dies 34 and 36 are used to deform the sections 30 and 32 into the shape that is illustrated in FIG. 5. Die 36 is a rod having an outer diameter, B. A collar or disc 104, having an inner diameter about equal to the outer diameter of die 36, is slid over the die, and secured to the die by a set screw threaded into a threaded aperture 108 in the disc. The disc 104 is secured to the die 36 adjacent a radially extending aperture 37 in the die. The outer diameter of disc 104 is about equal to the inner diameter of the tube element 10.

As can be seen in FIG. 8, the die 36 is inserted into the first end 22 of the tube element with its center line coincident with the center line 20 of the tube element. The radially extending aperture 37 in the die 36 is positioned so that it can confront the opposing arcuate section 30 or 32 to be formed. The disc 104 is thereby positioned within the tube element 10 immediately inward of the slits 26 and 28.

A die 34, formed from a rod, is used to deform the opposing arcuate sections 30 and 32 against the die 36. Die 34, illustrated in FIGS. 6 and 7, shows the end 38 of the die to be formed with a concave curvature 40 and convex curvatures 42 and 44. As can be appreciated, the die 34 is moved toward die 36 and tube element 10 along a line 46 perpendicular the center line 20 to contact an opposing arcuate section 30 or 32 and deform it into the shape shown in FIG. 5. The diameter B of die 36 is preferably somewhat less than the desired final interior diameter E of the tube element so that the natural rebound of the material of the tube element will cause it to expand to the diameter E after the force is removed from the dies. Further, the concave curvature 40 is preferably of a slightly less radius than the diameter B, again to form a desirable final product.

Holes 48 and 50 are formed through arcuate sections 30 and 32, respectively, to provide a point to solder a coaxial cable and/or to secure the tube element to rod 202 by solder, screws, rivets, pop rivets, or other suitable techniques. A hole punch 35 can be mounted on die 34, as seen in FIGS. 7 and 8, to form the holes 48 and 50 at the same time the arcuate sections 30 and 32 are formed. The aperture 37 in the die 36 accommodates the punch as the die 134, deforms the arcuate sections 30 and 32. Holes 48 and 50 also can act as guides to position the tube element on the rod. Similar holes 52 and 54 are formed through the tube element a distance F from the second end 24. Smaller holes 56 and 58 are formed a distance G from the second end 24 and spaced about the circumference of the tube element and angle $\theta$ from the holes 52 and 54.

FIG. 4B illustrates a modification of the tube element 10 in which the opposing slits 26 and 28 are made a distance X from the first end and a second pair of opposing slits 27 and 29 are cut through the sidewall of the tube element a distance Y from the first end. The sections 31 and 33 defined between the slits 26 and 27 and between slits 28 and 29, respectively, are deformed into the shape illustrated in FIG. 4B, leaving the portion of the tube element between slits 27 and 29 and the first end of the tube at the original diameter of the tube element.

In one tube element made in accordance with the teachings of the present invention. The tubing was 1½ inch O.D. by 0.032 inch wall thickness brass tubing. The slits 26 and 28 were cut with a slitting saw 0.040±0.005 inches with the cuts being 1 3/16 inches long. The dimension A was 0.35 inches. The holes 48 and 50 were centered 0.175 inches from the first end 22. The holes 54 were centered 1.0 inches from the second end 24. The holes 56 and 58 were centered 0.12 inches from the second end and 25° about the circumference of the tube element from holes 52 and 54, respectively. Holes 48 and 50 had a diameter of ⅛ inch. Holes 52 and 54 had a diameter of 9/64 inch. Holes 56 and 58 had a diameter of 5/64 inch. The dimension E was 7/16 inch. In die 36, dimension B was 0.625 inches. In die 34, the concave curvature was 0.320 inches and the convex curvatures were 0.103 inches. The distance between the points of transition between the concave curvature 40 and the convex curvatures 42 and 44 was 0.33 inches. The hole 37 was 0.144 inches in diameter and 0.250 inches deep. The inner diameter of collar 104 was 0.628 inches while the outer diameter was 1.050 inches. The collar was 0.500 inches long and hole 108 was centered 0.250 inches from either end of the collar.

It will occasionally be desirable to position the antenna assembly 200 within a larger container or tube 250, as seen in FIG. 11. It is desirable to ensure the concentricity of the antenna assembly elements within the tube 250 and to prevent them from rattling therein, and this can be accomplished by employing a non-conductive centering disc 252 which has an outer diameter to fit within the inner diameter of the tube 250 and an annular step 254 to slide within the end of the tube element 10 opposite the bracket. The centering disc 252 thus holds the free end of the tube element 10 concentric with the tube 250, and also assists in holding the antenna rod 202 concentric thereto.

As illustrated in FIG. 3, there are occasions when tube elements 10 will be mounted close together along the antenna rod 202 with the ends of each of the tube elements 10 opposite the bracket facing each other. In such a situation, a non-conducting spacer 256 can be mounted between the tube elements 10 as shown in FIG. 12. The spacer 256 will have annular steps 258 and 260 which are received in the ends of the tube elements 10. Both centering discs 252 and spacer 256 can, for example, be made of plastic.

Although a single embodiment of the invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit and scope of the invention.

What is claimed is:

1. A method for making a bracket from a tube of first diameter, comprising the steps of:

(a) cutting a first set of opposing slots into the tube at a predetermined distance from the end of the tube creating opposing arcuate sections between said slots and the end of said tube, the slots being generally perpendicular to the center line of the tube; and (b) deforming the opposing arcuate sections of the tube formed between the slots and the end of the tube toward the center line of the tube to form a bracket of a second diameter.

2. The method of claim 1 wherein the step of deforming the opposing arcuate sections further comprises the steps of:

positioning a rod of predetermined external diameter into the tube coaxially with said tube, the rod extending for at least a substantial portion of the distance between the end of the tube and the slots; and moving opposing dies together along a direction perpendicular to the center line of the tube to deform the opposing arcuate sections against the rod to form the bracket.

3. The method of claim 1 further comprising soldering the tube to an antenna rod at the bracket to form a tubular antenna.

4. The method of claim 1 further comprising the step of cutting a second set of opposing slots into the tube between the first set of slots and the end, a set of opposing arcuate sections to be deformed lying between the first and second set of slots.

5. A tube element, comprising:

a tube of first diameter having a first set of opposing slots cut into the tube at a predetermined distance from an end of the tube, the slots being generally perpendicular to the center line of the tube, opposing arcuate sections being defined between the end of the tube and the slots, said opposing arcuate sections deformed toward the center line of the tube to form a bracket of a second diameter.

6. The tube element of claim 5 further having a second set of opposing slots cut into the tube at a second predetermined distance from the end of the tube, the opposing arcuate sections lying between the first and second set of slots.

7. A method for making a bracket from a tube of first diameter, comprising the steps of:

(a) cutting a first set of opposing slots into the tube, the slots generally perpendicular to the center line of the tube;

(b) cutting a second set of opposing slots into the tube, the slots being generally perpendicular tot he center line of the tube to create opposing arcuate sections between said first set and said second set of opposing slots;

(c) positioning a rod of predetermined external diameter into the tube coaxially with the tube, the rod extending the distance between said slots;

(d) moving opposing dies together along a direction perpendicular to the center line of the tube to deform the opposing arcuate sections against the rod to form the bracket of a second diameter; and (e) soldering the tube to an antenna rod at the bracket to form a tubular antenna.

8. A tube element bracket for use in mounting antenna or radiating elements comprising:

a tube of first diameter; a pair of opposing slots cut into the tube, the slots being generally perpendicular to the center line of the tube; and said tube further having at least two opposing arcuate sections formed by the portion of the tube between the opposing slots and the end of the tube when said portion is deformed toward the center line of the tube to form a bracket of a second diameter coaxial with said first diameter.

9. The tube element of claim 8 wherein said opposing arcuate sections are deformed to create a centering structure of second diameter, said second diameter being smaller than said first diameter.

* * * * *

UNITED STATES PATENT AND TRADEMARK OFFICE

CERTIFICATE OF CORRECTION

PATENT NO. : 5,105,199

DATED : April 14, 1992

INVENTOR(S) : Ukmar

It is certified that error appears in the above-identified patent and that said Letters Patent is hereby corrected as shown below:

Column 4, line 4, after "134", delete --,--.

Column 4, line 29, after "The holes", insert --52 and--.

Column 6, line 18, delete "tot he", and insert --to the--.

Signed and Sealed this

Fifth Day of October, 1993

Bruce Lehman

*Attest:*

BRUCE LEHMAN

*Attesting Officer*

*Commissioner of Patents and Trademarks*